United States Patent [19]

Etheredge, III et al.

[11] Patent Number: 4,967,632

[45] Date of Patent: Nov. 6, 1990

[54] PAD WITH IMPRESSION MEMORY

[75] Inventors: Robert W. Etheredge, III, Natick; Steven A. Wasser, Wellesley, both of Mass.

[73] Assignee: Verne Q. Powell Flutes, Inc., Arlington, Mass.

[21] Appl. No.: 261,604

[22] Filed: Oct. 24, 1988

[51] Int. Cl.[5] ..... G10D 7/08

[52] U.S. Cl. ..... 84/385 P

[58] Field of Search ..... 84/385 R, 385 P; 264/22, 242, 250, 268, 275, 278

[56] References Cited

U.S. PATENT DOCUMENTS

| | | | |
|---|---|---|---|
| 3,247,749 | 4/1966 | Gullotta | 84/385 R |
| 3,691,892 | 9/1972 | Matsuura et al. | 84/385 P X |
| 3,958,484 | 5/1976 | Nelson et al. | 84/385 P X |
| 4,114,500 | 9/1978 | Norbeck | 84/385 P |
| 4,158,979 | 6/1979 | Suzuki | 84/385 P |
| 4,453,444 | 6/1984 | Valentino | 84/385 P |
| 4,704,939 | 11/1987 | Straubinger | 84/385 P |
| 4,708,047 | 11/1987 | Kanazawa et al. | 84/385 P |
| 4,798,122 | 1/1989 | Gisler et al. | 84/385 P |

OTHER PUBLICATIONS

"Information about High Technology Silicone Materials", Dow Corning Corp., 1983, Form No. 10-037A-83.

"RTV Silicone Rubber Product Data", General Electric Company, Rev. 6/80, CDS-1870A.

*Primary Examiner*—Brian W. Brown

*Attorney, Agent, or Firm*—Joseph S. Iandiorio

[57] ABSTRACT

A pad for use in a pad cup positioned over an opening in a musical instrument, the pad having a seal element which initially forms an impression of the rim of the opening and fixes the impression. The pad further includes a support member which carries the seal element to securely position the impression relative to the rim to seal the opening when the pad is brought to bear against the rim. The support element also damps vibrations generated when the seal element contacts the rim.

30 Claims, 4 Drawing Sheets

PAD WITH IMPRESSION MEMORY

FIELD OF THE INVENTION

This invention relates to a pad for closing a tone hole or other opening in a musical instrument and more particularly to such a pad which retains a fixed impression of the rim of the opening.

BACKGROUND OF INVENTION

Many musical instruments utilize selective opening and closure of numerous openings in the instrument to change the sound produced by the instrument. Flutes, for example, typically have seventeen or eighteen pads which cover respective tone holes. Accurate and repeatable sealing of the tone holes is essential for producing crisp, clean tones. Other instruments utilize pads to selectively cover "spit" holes through which condensed moisture is expelled.

The most prevalent pads are a composite of cardboard, wool felt, and a collagen membrane covering the felt and attached to the cardboard. The pad is secured within a pad cup by a screw and washer or an adhesive. However, a great deal of effort is required to properly align the pad with the rim of the opening over which the pad is positioned. Highly skilled padders utilize paper or plastic shims of about 0.001 to 0.012 inch thick to adjust the alignment of the pad. Alternatively, certain pads can be floated into position on a bed of shellac or other adhesive. Each shimming adjustment requires the removal of the pad from the pad cup to position new shims. Proper padding of the flute often takes three or more days to accomplish. Even with proper shimming or floating, the pads are limited in their ability to conform to irregularities in the rim.

Moreover, the collage; membranes, referred to as "fish skins", are subject to charge over time. The membranes have different fiber densities which differentially absorb moisture resulting in differential swelling. Differential swelling of the pad defeats a proper seal between the rim and the pad, and can also result in excessive wear in portions of the membrane covering.

Great effort has been expended in developing new pads which attempt to address one or more of the above-mentioned problems. Some of these pads still require complicated shimming, such as by selectively bending a metal collar. Others rely on synthetic materials to deform sufficiently to establish a proper seal. Many of these pads are too soft, however, and produce a "spongy" feel during use. Instead, a crisp, slightly resilient action is desired.

Pad materials must withstand a harsh environment involving corrosive saliva and other moisture, and rapid changes in temperature. Further, it is important for the pad to be quiet during operation and not to adhere to the rim. It is also desirable to minimize buildup of static charge, to resist mildew, and to combat odors which can develop when the instrument is left in its carrying case.

SUMMARY OF INVENTION

It is therefore an object of this invention to provide a pad which accurately and repeatedly seals a tone hole or other opening in a musical instrument.

It is a further object of this invention to provide such a pad which provides a hermetic seal which lasts over time and does not vary with ambient temperature or humidity.

It is a further object of this invention to provide such a pad which enables crisp action of a pad cup carrying the pad.

It is a further object of this invention to provide such a pad which is durable, relatively simple in construction, and inexpensive.

Yet another object of this invention is to provide such a pad which is quiet and does not adhesive to the rim of the opening.

It is a further object of this invention to provide such a pad which is inert to humans and to components of the musical instrument. A still further object of this invention is to provide such a pad which can release anti-mildew agents, antistatic agents, air fresheners, or other agents.

It is a further object of this invention to provide such a pad which can be reconfigured to accommodate changes in the rim of the opening in the musical instrument or to accommodate a different rim.

This invention results from the realization that a truly effective pad for a musical instrument can be achieved by a seal element formed of a material which initially forms an impression of the rim of an opening in the instrument and which fixes the impression of the rim to enable repeatable hermetic sealing of the opening, the seal element being carried by a support member which securely positions the impression relative to the rim and dampens vibrations generated when the seal element contacts the rim.

This invention features a pad for use in a pad cup positioned over an opening in a musical instrument. The pad includes seal means for initially forming an impression of the rim of the opening to establish a custom fit with the ring and for fixing the impression. The pad further includes support means, disposed within the pad cup, for carrying the impression to securely position the impression relative to the rim to maintain the custom fit to ensure that the opening is sealed when the pad is brought to bear against the rim. The support means also damps vibrations generated when the seal means contact the rim.

In one embodiment, the seal means is formed of a thermoplastic or thermosetting material. The material has a lower melting point than the support means and bonds with the support means when melted and then solidified. The material of the seal means is hydrophobic and is a mixture of resin and one to fifty percent Carnauba wax. The resin is a copolymer of ethylene and vinyl acetate.

The support means is formed of an elastomeric material such as a silicone elastomer. The support means includes a recess in which the seal means is disposed, that recess being ring-shaped or disk-shaped. The seal means has a shape which matches that of the recess and both may be curved in cross-section. Preferably, the seal means is an inset within the support means wherein the surface of the seal means having the impression lies substantially flush with the surface of the support means which faces away from the pad cup.

The pad may further include positioning means which minimizes rotational and translational movement of this seal means relative to the rim. The positioning means includes an indentation on one of the seal means and the support means, and a matching projection on the other of the seal means and support means to engage the indentation. In one embodiment the positioning means includes two or more annular indentations on the support means and matching annular projections on the seal means. The pad may further include means for securing the support means within the pad cup and a volatile agent, a germicide, or an antistatic agent within the seal means.

This invention also features a method of constructing a pad, including placing seal means in the recess of support means, and heating at least a portion of the pad to melt the seal means to induce flow into the recess to match the shape of the recess. The seal means is solidified in the recess, and the pad is installed in a pad cup positioned over an opening in a musical instrument. The method further includes softening the seal means and pressing it against the rim of the opening to form an impression of the rim, and hardening the seal means to fix the impression.

DISCLOSURE OF PREFERRED EMBODIMENT

Other objects, features and advantages will occur to those skilled in the art from the following description of a preferred embodiment and the accompanying drawings, in which.

Figure 4B:
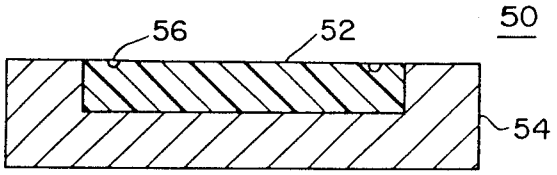
Figure 4A:
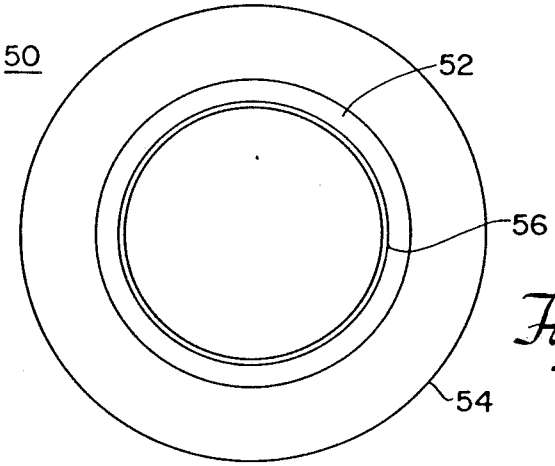

FIG. 4*a* is a bottom plan view of an alternative pad according to this invention; and FIG. 4*b* is a cross-sectional view of the pad of FIG. 4*a*.

A pad according to this invention may be used to cover a tone-hole, spit-hole or other opening in a musical instrument. The pad is secured within a pad cup positioned over one of the openings and includes a seal element which initially forms an impression of the rim of the opening to establish a custom fit with the rim. After being formed, the impression is fixed to maintain its match to the contours of the rim. The pad further includes a support member which carries the seal element to securely position the impression relative to the rim to maintain the custom fit to insure that the obtaining is sealed when the pad is brought to bear against the rim. The support member also damps vibrations generated when the seal element contacts the rim.

Figure 1:
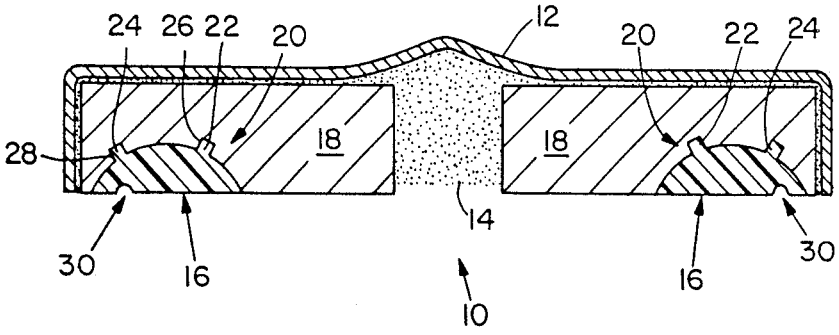
FIG. 1 is a cross-sectional vie; of a pad according to this invention mounted in a pad cup.

Pad 10 according to this invention, FIG. 1, is shown secured within pad cup 12 by hot melt or silicone adhesive 14. In another construction, pad 10 is secured by a screw and a washer.

Pad 10 is constructed of seal element 16 held securely by support member 18. The attachment between seal element 16 and support member 18 is augmented by positioning mechanism 20 established by projections 22, 24 of seal element 16 which engage matching indentatiors 26, 28 of support member 18. Positioning mechanism 20 minimizes rotational and translational movement of seal element 16 relative to support member 18.

Figure 2:
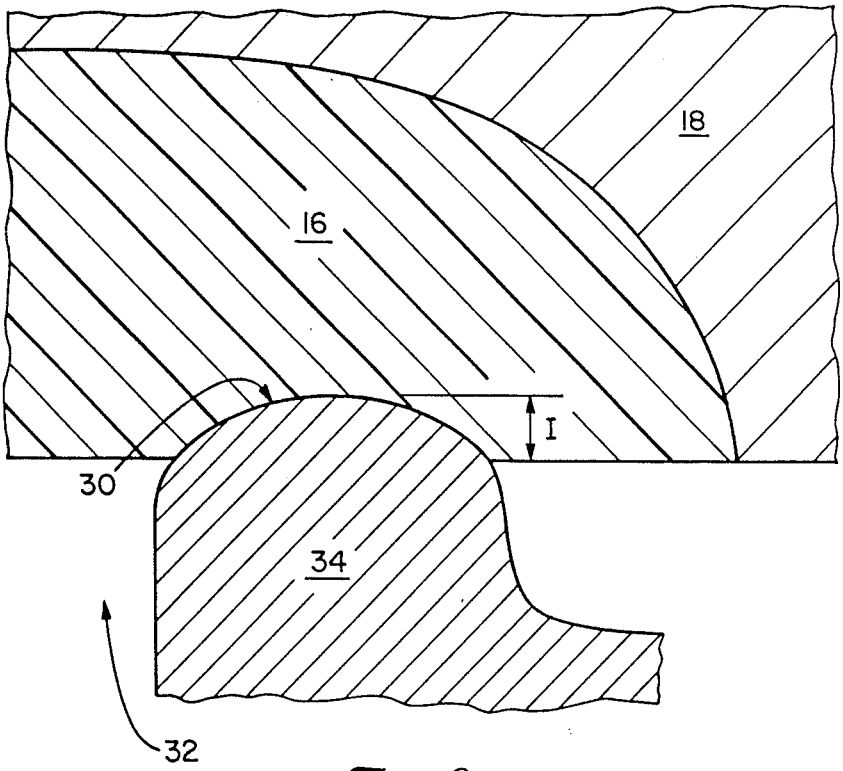
FIG. 2 is a cross-sectional view of a portion of the seal element of FIG. 1 contacting the rim of a tone hole.

During use, it is important that impression 30 be securely positioned relative to the rim of the opening such as shown in FIG. 2 for opening 32 of a tone hole Impression 30 is initially formed, as described below to establish a custom fit with rim 34. The depth of impression 30 is represented by arrow I which is typically 0.5 mm. Rather than a single point of contact, a substantial surface area of seal element 16 contacts rim 34 to establish a hermetic seal. Such a seal is important for producing clear, crisp tones when the instrument is played.

It is desirable that seal element 16 be formed of a material which has a relatively low melting point (greater than the highest storage temperature of the device) and is inert to water, saliva, and other solvents which may be encountered during normal use of the musical instrument. Also desirable is for the material to be thermoplastic or thermosetting so that the impression can be established by heating the material. Thermoplastic material provides the advantage of allowing the pad to be reset to the same or a different opening at a later date. It is further desirable for the material to have a high adhesion to the support member, at least when solidified, and a low viscosity when melted. It is also desirable for the material to be hydrophobic and nontoxic to the user and the components of the musical instrument.

In one construction, seal element 16 is formed from a mixture of resin and microcrystalline wax. The resin is a copolymer of ethylene and vinyl acetate. One such resin is ELVAX 150 available from DuPont. ELVAX 150 has a vinyl acetate.

content of approximately 32–34% and softens at 110° C. When mixed with 10–20% Carnauba wax, the softening point of the mixture is lowered to 85–90° C. Further, the wax minimizes adhesion between the tone hole rim and the pad, lowers the melt viscosity of the mixture to enable both quick installation in the support member and rapid formation of the impression. The wax also increases the hardness of the resin when cool and lowers the surface energy to increase water resistance.

In addition, the microcrystalline nature of the wax when mixed with the resin allows microphane formation of the wax which can establish reservoirs for slow release of volatile agents, germicides such as Hyamine, or antistatic agents such as Quaternary ammonium salts. In other words, the wax separates as a microphase "filler" which modifies the properties of the resin and serves as a slow release reservoir. As an example, a formulation of 70% ELVAX 150, 27% Carnauba wax and 3% cinnamon oil delivered a mild cinnamon aroma for over four months. Higher molecular weight oils may be delivered over longer periods. Such a volatile agent freshens the air inside the instrument case by countering stale odor produced during storage. Preferably, 1 to 50% Carnauba wax is employed although the resin itself serves as an adequate seal element.

The seal element is bonded to the support member by placing seal material in solid form within a recess in the support member and then heating it. To form ring-shaped seal element 16, for example, an "O"-ring of resin and wax is installed in recess 40 of support member 18, FIG. 3. Support member 18 is oriented so that recess 40 faces upwardly, opposite from the orientation shown in FIG. 3. The entire assembly is then heated to melt the seal material which flows into coaxial annular indentations 26, 28 and bones with the surface of recess 40. It is desirable to form support member 18 with a roughened surface within recess 40 to enhance bonding with the seal material.

After the pad is sealed in the pad cup by tightening the screw and washer assembly or by setting the adhesive, the impression of the rim is formed in the seal element. The entire instrument can be heated to the softening temperature of the seal element, after which the key attached to the pad cup is depressed to form the impression. A travel limiter can be used to precisely control the depth of impression. The pad is held against the rim until the real element cools. Alternatively, each rim can be heated using a flat plate placed against the rim, after which the pad is brought to bear against the rim. To form a new impression, heat may be applied to the pad cup and pad to remelt the seal element and erase the former impression. The pad is then resealed by bringing it to bear against the new rim. In one example, ten resealings were accomplished with the same pad, the seal element being a mixture of resin and Carnauba wax.

It is desirable for the support member to be formed of an elastomeric material to dampen any vibrations which may arise when the seal element is brought to wear against the rim. The compressive response of the support member also determines the "feel" of the key associated with this pad cup. It is further desired that the material have a high heat tolerance and moisture resistance and a low coefficient of thermal expansion. It is also desired for the material to retain elastomeric response over time and to be inert to ultraviolet light and solvents with which it may come in contact during use of the instrument.

One material which exhibits these features is Sylgard 186 high tear strength silicone elastomer available from Dow Corning, Midland, Michigan. Sylgard 186 is an excellent acoustic absorber and, as is a support member, absorbs closure noises, i.e., vibrations generated when the seal element contacts the rim. Because the support member is positioned between the rim and the pad cup, Sylgard 186 effectively isolates closure noises from the pad cup and the remainder of the instrument. This material also has a high tear strength, very low thermal expansion, and excellent heat stability over approximately minus 85° F. to 482° F. These properties readily accommodate thermal manipulation of the seal element. Also acceptable is Silicone Rubber RTV (room temperature vulcanizing) 615 available from General Electric.

Figure 3:
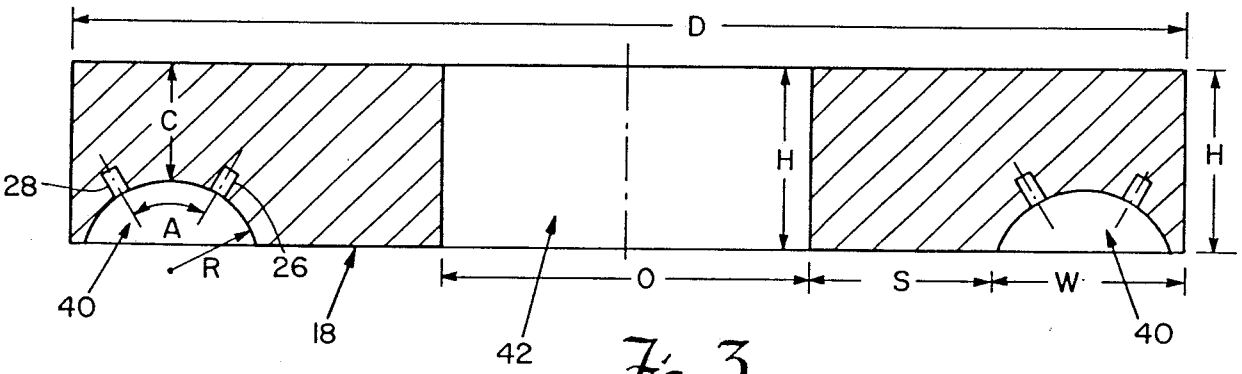
FIG. 3 is a schematic cross-sectional view of the support member shown in FIG. 1.

A support member, as shown in FIG. 3, having the following dimensions was constructed for a tone hole for the foot joint of a flute:

| | |
|---|---|
| Diameter D | 18 mm |
| Opening of hole 42 | 6 mm |
| Height H | 3 mm |
| Shoulder S | 3 mm |
| Width W of recess 40 | 3 mm |
| Angle A between indentations 26, 28 | 30° |
| Compressability depth C | 2 mm |
| Radius R | 1.5 mm |

As discussed above, the shape o recess 40 determines the shape of the seal material when it is melted and flows to conform to recess 40. Compressability depth C controls the "feel" when the player closes the paid cup. Hole 42 accommodates the screw and the threaded base which accepts the screw. Shoulder S accommodates the washer when this mechanism is used instead of adhesive for attachment. An advantage of the screw and washer is that the metallic components provide a path to ground for static charges which may build up at the surface of the pad. Further, a washer and screw enable adjustment of the compression under which support member 18 is placed. Tonal qualities may be affected by the washer and screw attachment mechanism.

In this construction seal element 16 is an inset within support member 18. The surface of seal element having the impression is formed to lie substantially flush with the surface of support member 18.

While the above seal element is described as ring-shaped, this is not a limitation cf the invention. Pad 50 according to this invention, FIGS. 4A, 4B, for example, has disk-shaped seal element 52 carried by support member 54. Seal member 52 forms and fixes impression 56. Pad 50 is especially suited for smaller-diameter openings in a musical instrument. Seal element 52 and support member 54 in one construction are bonded to each other and in another construction are attached with a separate adhesive.

Further, other materials may be used for the seal element which do not require heating for example, a material which sublimes or vaporizes when pressed against the rim may be used. Alternately, a special solvent may be applied to the rim which dissolves a portion of this seal element to form an impression may be utilized.

Although specific features of the invention are shown in some drawings and not others, this i; for convenience only as each feature may be combined with an, or all of the other features in accordance with the invention.

Other embodiments will occur to those skilled in the art and are with the following claims:

What is claimed is:

1. A pad for use in a pad cup positioned over an opening in a musical instrument, comprising:

seal means for initially forming an impression of the rim of the opening to establish a custom fit with the rim, and for fixing the impression; and support means, disposed within the pad cup, for carrying said seal means to securely position the impression relative to the rim to maintain the custom fit to ensure that the opening is sealed when the pad is brought to bear against the rim, and for damping vibrations generated when said seal means contact the rim; and positioning means for minimizing rotational and translational movement of said seal means relative to the rim, said positioning means including an indentation on one of said seal means and said support means and a matching projection on the other of said seal means and support means for engaging said indentation.

2. The pad of claim 1 in which said seal means is formed of thermoplastic material.

3. The pad of claim 1 in which said seal means is formed of thermosetting material.

4. The pad of claim 2 in which said seal means is formed of material having a lower melting point than said support means.

5. The pad of claim 1 in which said seal means is formed of material which bonds with said support means when melted and then solidified.

6. The pad of claim 1 in which said seal means is formed of material which is hydrophobic.

7. The pad of claim 1 in which said seal means includes a resin.

8. The pad of claim 1 in which said seal means is a mixture of resin and wax.

9. The pad of claim 8 in which the wax is Carnauba wax.

10. The pad of claim 9 in which the mixture includes one to fifty percent Carnauba wax.

11. The pad of claim 8 in which the resin includes vinyl acetate.

12. The pad of claim 8 in which the resin is a copolymer of ethylene and vinyl acetate.

13. The pad of claim 12 in which the wax is a microcrystalline wax.

14. The pad of claim 1 in which said support means is formed of elastomeric material.

15. The pad of claim 14 in which the elastomeric material is a silicone elastomer.

16. The pad of claim 1 in which said support means includes a recess in which said seal means is disposed.

17. The pad of claim 16 in which said recess and said seal means are ring-shaped.

18. The pad of claim 16 in which said recess and said seal means are disk-shaped.

19. The pad of claim 16 in which the recess and said seal means are curved in cross-section.

20. The pad of claim 16 in which the surface of said seal means having the impression lie; substantially flush with the surface of said support means which faces away from the pad cup.

21. The pad of claim 1 further including positioning means for minimizing rotational and translational movement of said seal means relative to the rim.

22. The pad of claim 21 in which said positioning means includes an indentation on one of said seal means and said support means, and a matching projection on the other of said seal means and said support means for engaging the indentation.

23. The pad of claim 22 in which said positioning means includes at least two annular indentations on said support means and matching annular projections on said seal means.

24. The pad of claim 1 further including means for securing said support means within said pad cup.

25. The pad of claim 1 in which said seal means includes at least one of a volatile agent, a germicide, and an antistatic agent.

26. A pad for use in a pad cup positioned over a tone hole in a musical instrument, comprising:

thermoplastic seal means having a softening point temperature above the highest storage temperature of the instrument for initially forming an impression of the rim of the tone hole to establish a custom fit with the rim whenever said seal means is heated to said softening point and for fixing the impression when said seal means is cooled below said softening point; and elastomeric support means, disposed within the pad cup, for carrying said seal means to securely position the impression relative to the rim to maintain the custom fit to ensure that the tone hole is hermetically sealed when the pad is brought to bear against the rim, and for damping vibrations generated when said seal means contacts the rim.

27. The pad of claim 26 further including positioning means for minimizing rotational and translational movement of said seal means relative to the rim.

28. A method of constructing a pad having seal means carried by a recess in support means comprising:

placing the seal means in the recess;

heating at least a portion of the pad to melt the seal means to induce flow into the recess to match the shape of the recess;

solidifying the seal means within the recess;

installing the pad in a paid cup positioned over an opening in a musical instrument;

softening the seal means and depressing it against the rim of the opening to form an impression of the rim; and hardening the seal means to fix the impression of the rim.

29. A cup assembly for valving an opening in a musical instrument comprising:

a cup;

an adhesive medium in said cup;

a support member securely embedded in said adhesive medium in said cup, said support member including an annular channel; and a thermoforming seal means disposed in said channel for forming and fixing an impression of the rim of the opening one of said channel and said seal means including an indentation and the other including a projection for engaging said indentation and securing the position of said seal means in said channel.

30. The cup assembly of claim 29 in which said indentation and projection are annular and coaxial with said channel.

* * * * *